United States Patent [19]

McQueen

[11] 4,148,255

[45] Apr. 10, 1979

[54] BALING MACHINE

[76] Inventor: Alfred S. McQueen, 213 E. Unaka Ave., Johnson City, Tenn. 37601

[21] Appl. No.: 846,171

[22] Filed: Oct. 27, 1977

[51] Int. Cl.[2] ..... B30B 1/04

[52] U.S. Cl. ..... 100/247; 100/3; 100/218; 100/274; 100/295

[58] Field of Search ..... 100/274, 275, 295, 3, 100/218, 219, 226, 227, 228, 240, 246, 247, 288, 289

[56] References Cited

U.S. PATENT DOCUMENTS

| | | | |
|---|---|---|---|
| 247,051 | 9/1881 | Harbaugh | 100/228 X |
| 1,002,651 | 9/1911 | Daubenspeck | 100/288 X |
| 1,203,288 | 10/1916 | Webster | 100/247 |
| 2,533,282 | 12/1950 | Osman | 100/228 X |
| 2,955,530 | 10/1960 | Nilo | 100/289 |
| 3,734,008 | 5/1973 | Akerberg | 100/226 X |
| 4,056,053 | 11/1977 | Akerberg | 100/226 X |

FOREIGN PATENT DOCUMENTS

| | | | |
|---|---|---|---|
| 2455067 | 5/1976 | Fed. Rep. of Germany | 100/274 |

*Primary Examiner*—Billy J. Wilhite

[57] ABSTRACT

Disclosed is a compactor which may be utilized to compact waste material including small wood or bark pieces and chips, paper, and paper cartons and form the material into a useful form such as fireplace logs. The device employs a cylinder which is removable from a base, and a piston, the rod of which extends through a head removable from the top of the cylinder for loading. Special bail port construction provides for setting a baling wire in place in the cylinder, holding it in place during loading and compression, securing the compression material in its compacted condition with the bail, and removing the formed and secured product from the compactor.

10 Claims, 6 Drawing Figures

BALING MACHINE

The present invention concerns improved waste material compacting means having very economical, efficient, and simplified construction for home use and being capable of forming compressed fireplace logs of very suitable density and burning characteristics from waste paper and the like.

The invention is characterized in its general sense as a compactor comprising an elongated cylinder removably secured to a base, at least two bail ports in an upper portion of the wall of said cylinder substantially oppositely, circumferentially disposed therethrough, a cap removably secured to the top of said cylinder, a prime mover secured to said cap, a piston slidable within said cylinder and having a connecting rod sufficiently long to extend a substantial portion of the length of said cylinder and connected to said prime mover, said prime mover being operable to force said piston axially through a portion of said cylinder to compact material therein and being further operable to allow release and axial withdrawal of said piston from its compacting position, and groove means in the bottom of said piston adapted for angular alignment with said bail ports.

The invention will be understood more fully from the following detailed description and drawings wherein FIG. 1 is a longitudinal, sectional view of the compactor;

Figure 1:
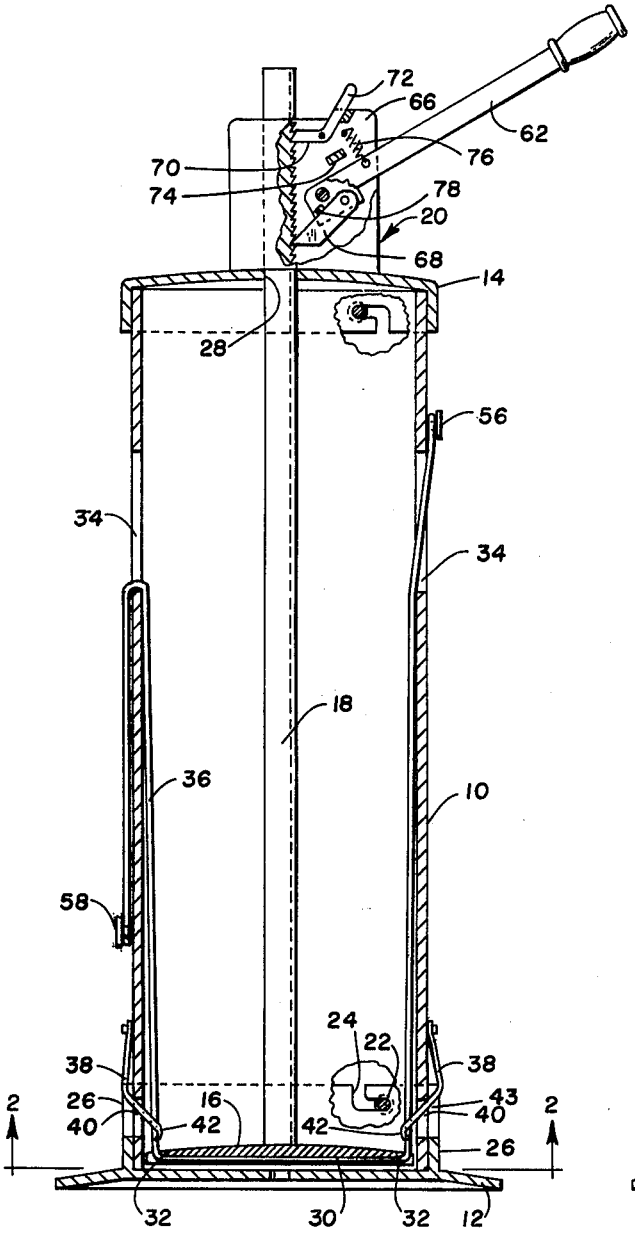
Figure 4:
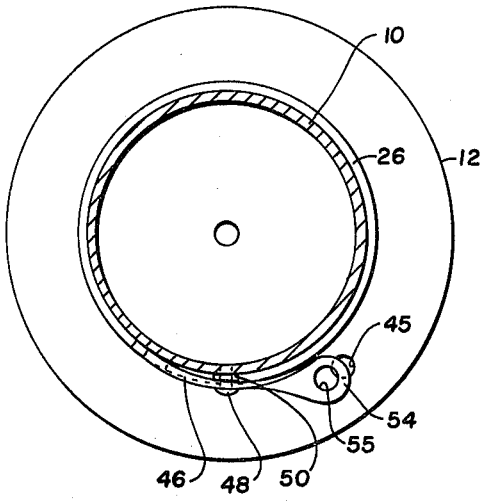
FIG. 4 is a top view of that portion of the compactor shown in FIG. 3.

Referring to the drawings, the compactor comprises an elongated cylinder 10 of any cross-sectional configuration, but preferably circular, base 12, cap 14, piston 16, connecting rod 18, and prime mover 20. The cylinder is removably secured to the base by any convenient means such as latches and the like, but preferably by studs 22 fixed to the cylinder and adapted to lock and unlock by proper rotative motion in bayonet type slots 24 formed in collar 26 fixed on base 12. The upper portion of the cylinder and cap 14 preferably are similarly provided with such studs and slots to provide easy assembly and removal of the cap from the cylinder.

Piston 16 preferably is fixed in position to rod 18 for a purpose hereinafter explained, and is slidably fitted through a keyway functioning aperture 28 in the cap to connect with prime mover 20 secured to the cap. Prime mover 20 preferably is a hand levered ratchet jack such as a conventional automobile bumper jack. The jack specifically shown in the drawing is a modified bumper jack and its advantages will be described in more detail below. Another suitable type of prime mover would be a rack and pinion arrangement wherein the rack is the connecting rod 18 and the pinion gear replaces the pawl of the jack shown. Power means such as electric motor and screw shaft may be employed, but the hand jack is preferred for mechanical operating effectiveness and maximum low cost power.

Piston 16 is specially constructed, having at least one groove 30 substantially along a diameter thereof, and preferably extending at its ends into recesses 32. Bail ports 34 are provided in the upper portion of the cylinder and become substantially aligned along the same diameter as that of groove 30 when cap 14 is locked in place and may extend upwardly through the top of the cylinder for a purpose described below. It is particularly noted, and will become apparent from further discussion below, that an important and highly preferred aspect of the invention is that groove 30 must be at least as wide as the length of the slots 24. This construction allows cap 14 to be locked onto the cylinder without rotating groove 30 out of registry with bail ports 34.

In the loading of the compactor, cylinder 10 is slid into collar 26 and locked to based 12 by means of the aforesaid bayonet slots and studs, and a bail 36 preferably of readily formable wire is inserted through ports 34 to extend outwardly a suitable distance from opposite sides of said cylinder. Waste material is then placed in the cylinder above the bail, and cap 14 is locked to the cylinder with piston 16 retracted. The piston is then actuated by the prime mover to push the waste material and the bail to the bottom of the cylinder to metal-form the bail and compress the initial charge of waste material such as to hold the bail in place as the piston is retracted for removing the cap for another charge. An important embodiment of the present invention is to form the bail first by pressing it down by the piston and holding it in place at the bottom of the cylinder by means of retainers 38 which are preferably pinned to the cylinder wall and insertable through access apertures 40. These retainers are provided with semi-hooked ends 42 which are removably positionable around the bail as discussed below in greater detail. It is noted that collar 26 may be notched downwardly in the area 43 of the retainers to provide for easy access to apertures 40.

Figure 3:
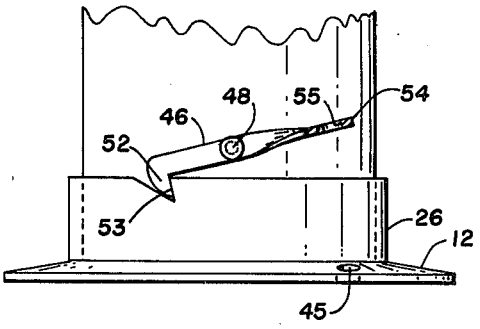
FIG. 3 is a side elevation of the lower portion of the compactor.
Figure 2:
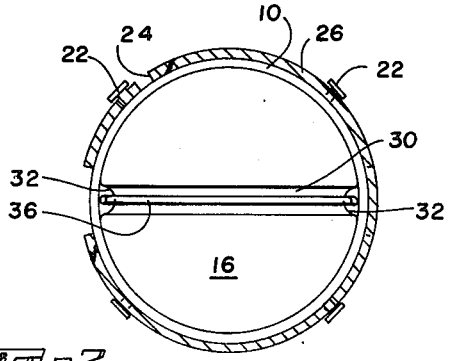
FIG. 2 is a cross-sectional view of FIG. 1 taken along line 2–2 thereof in the direction of the arrows.

In order to allow easy separation of the cylinder and base and to prevent premature unlocking of the cylinder and base during removal of cap 14, the base is provided with aperture 45, and the cylinder is provided with a lever 46 pivotally mounted on the cylinder by pin 48 and friction reducing spacer 50, and has a shoulder 52 on one end and an aperture 55 adjacent the other end 54. For unlocking the cylinder and base, a rod may be inserted through aperture 55 extending into aperture 45 and urged clockwise in FIG. 3. This action tends to first push end 54 down to dislodge shoulder 52 from the notch 53 in collar 26, and then to rotate the cylinder with respect to the base to unlock stud 22 from slots 24. This mechanism prevents attempted removal of the cylinder without first removing shoulder 52 from notch 53. It is particularly noted that as the rod is inserted through the apertures, the operator will be reminded of the shoulder 52 and notch 53 and may readily assist the unlatching by urging end 54 of the lever 46 downwardly, for example, with his foot. The rod iself also may be provided with a shoulder for engaging lever 46 adjacent aperture 55 prior to its reaching aperture 45 such that the lever will be unlatched prior to the clockwise rotation of the rod.

As mentioned above, spring-like retainers 38 are of unique construction in that the ends thereof hook only partially around the bail, that is, they just suffice to hold the bail in a position whereby the piston 16, particularly the edges of recesses 32 thereof, do not bear against the bail with sufficient force to dislodge it from its operative down position in the cylinder. It is particularly noted that these retainers have a downward slope such that they will be cammed out of engagement with the bail as the bail and compacted material are ejected through the bottom of the cylinder during unloading as described below. These retainers preferably when pinned to the container are given an outwardly directed set such that ends 42 lie normally radially outwardly from the bail. This feature tends to urge the bail out of engagement with the piston and also to get the retainers out of the way when a new bail is being positioned in the bottom of the cylinder.

Figure 5:
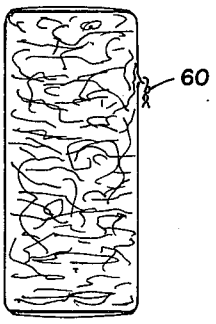
FIG. 5 is a side elevation of the compacted article.

The baling and unloading of the present device is accomplished by filling the cylinder until the compacted material comes up to a Unloading level, preferably contiguous the middle to upper portions of bail ports 34. With the piston against the top of the compacted material and groove 30 aligned with the bail ports, one of the ends of bail 36 is pushed or pulled through groove 30 until it extends out the other side. At this point, the free ends of the bail are twisted or otherwise joined together at 60 to form the finished article shown in FIG. 5. Excess end portions of the bail may be removed to give a compact article capable of being slidably removed from the cylinder. Unloding of the cylinder is accomplished by removing the base and jacking the compacted article out through the bottom of the cylinder. As the article moves downward through the cylinder, the ends 42 of retainers 38 are cammed out of engagement with the bail through force generated by the sliding contact of said ends with both the bail and the compacted article.

Figure 6:
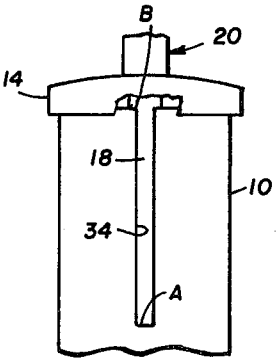
FIG. 6 shows a variation of the bail port viewed from right to left of FIG. 1.

An important variation of the present invention as shown in FIG. 6 comprises bail port 34 in the form of slots extending upwardly from point A all the way through the top of cylinder 10 at point B. This feature allows the use of preformed, predimensioned bails which are insertable into the cylinder and retained therein without the need for special retaining considerations. The ends of such bails are flexed slightly outwardly to clear cap 14, or may be bent and temporarily secured at 56 and 58 as shown in FIG. 1.

As indicated above, the preferred prime mover 20 is a modified type ratchet jack comprising a group of interrelated members which may take a wide variety of mechanical forms in accomplishing their functions. These members are a toothed stanchion 18, hand lever 62 pivotally mounted 64 to the housing 66, compression pawl 68, and hold pawl 70. In order to allow for retraction of piston 16, hold pawl 70 which is spring urged into engagement with stanchion 18 is easily disengaged by counterclockwise motion of its handle 72. It is noted that lever 62 is normally urged toward a stop shoulder 74 by any type of spring such as 76, and pawl 68 is spring urged toward its stop 78. By means of this arrangement, release of clockwise directed pressure on lever 62 will disengage pawl 68 such that subsequent release of pawl 70 will allow easy retraction of the piston.

The invention has been described in detail with particular reference to preferred embodiments thereof, but it will be understood that variations and modifications can be effected within the spirit and scope of the invention.

I claim:

1. A compactor comprising an elongated cylinder removably secured to a base, at least two bail ports in an upper portion of the wall of said cylinder substantially oppositely, circumferentially disposed therethrough, a cap removably secured to the top of said cylinder, a prime mover secured to said cap, a piston slidable within said cylinder and having a connecting rod sufficiently long to extend a substantial portion of the length of said cylinder and connected to said prime mover, said prime mover being operable to force said piston axially through a portion of said cylinder to compact material therein and being further operable to allow release and axial withdrawal of said piston from its compacting position, and groove means in the bottom of said piston adapted for angular alignment with said bail ports.

2. The compactor of claim 1 wherein said bail ports are in the general form of slots which extend generally axially through the top of the cylinder wall to allow the insertion of preformed, predimensioned bails.

3. The compactor of claim 1 wherein the edges of said piston contiguous said groove means are recessed radially inwardly.

4. The compactor of claim 1 wherein bail access apertures are located in lower portions of the cylinder wall at positions of substantial angular alignment with said groove means in said piston.

5. The compactor of claim 1 wherein said piston is fixed in position on said connecting rod, and said connecting rod is nonrotatable but axially movable through said cap.

6. The compactor of claim 5 wherein cooperating locking means are provided on said cylinder and said cap adapted to releasably secure said cap to said cylinder with said groove means of said piston in angular alignment with said bail ports in said cylinder.

7. The compactor of claim 6 wherein cooperating locking means are provided on said cylinder, said cap and said base, for releasably securing said cap and said base to said cylinder with said groove means of said piston in angular alignment with said bail ports and said access apertures in said cylinder.

8. The compactor of claim 7 wherein said locking means comprises stud and cooperating bayonet slot means whereby selective rotation of the cap relative to the cylinder and of the cylinder relative to the base can lock and release the cap and the cylinder respectively.

9. The compactor of claim 1 wherein said prime mover comprises a hand levered ratchet jack, the stanchion of which is nonrotatably axially slidable through said cap and is affixed to said piston.

10. The compactor of claim 9 wherein the hand lever of said jack is provided with a compression pawl which is normally spring urged out of engagement with said stanchion, and is also provided with a hold pawl which is hand movable into and out of engagement with said stanchion to allow easy hand retraction of said piston axially of said cylinder.

* * * * *